US006390160B2

(12) United States Patent
Pitkäniemi

(10) Patent No.: US 6,390,160 B2
(45) Date of Patent: May 21, 2002

(54) CHOPPING MACHINE

(76) Inventor: Tarmo Pitkäniemi, Raikulitie 37 F, FIN 54850 Kuukanniemi (FI)

( * ) Notice: Subject to any disclaimer, the term of this patent is extended or adjusted under 35 U.S.C. 154(b) by 0 days.

(21) Appl. No.: 09/761,091

(22) Filed: Jan. 18, 2001

(30) Foreign Application Priority Data

Jan. 19, 2000 (FI) ..... 000109

(51) Int. Cl.[7] ..... B27L 7/08

(52) U.S. Cl. ..... 144/4.6; 144/193.1; 144/195.1; 144/242.1; 144/245.1; 144/250.21; 144/367; 148/750.11

(58) Field of Search ..... 144/4.6, 193.1, 144/195.1, 242.1, 245.1, 250.21, 250.22, 250.26, 366, 367; 198/468.2, 621.1, 750.11, 772; 414/746.8, 751.1

(56) References Cited

U.S. PATENT DOCUMENTS 3,862,651 A 1/1975 Heikkinen ..... 144/4.6
4,286,638 A 9/1981 Connolly et al. ..... 144/4.6
4,429,784 A * 2/1984 Cromeens ..... 144/245.1
4,609,018 A 9/1986 Barker ..... 144/4.6
5,156,259 A * 10/1992 Quaeck ..... 198/750.11

* cited by examiner

*Primary Examiner*—W. Donald Bray
(74) *Attorney, Agent, or Firm*—Young & Thompson

(57) ABSTRACT

The chopping machine includes a crosscutting device for cutting the timber, a feeder for feeding the timber in its longitudinal direction to the crosscutting device and a splitting apparatus operated by a splitting cylinder for splitting a cut block of timber. The feeder includes two elongated supporting surfaces forming a substantially horizontal trough open in the upward direction, into which the timber to be treated can be placed. One of the supporting surfaces is connected to a power device for moving the supporting surface back and forth in the longitudinal direction of the trough, and the supporting surfaces are provided with directional holding elements arranged in the longitudinal direction of the trough to prevent the timber from moving in relation to the surface away from the crosscutting device.

6 Claims, 2 Drawing Sheets

CHOPPING MACHINE

FIELD OF THE INVENTION

The present invention relates to a chopping machine.

BACKGROUND OF THE INVENTION

The chopping machines used in the production of small-dimensioned wood are generally divided into two different classes according to their method of crosscutting the timber. One class comprises chopping machines in which the trunks or timbers are crosscut by slashing or shearing, while the other class comprises chopping machines that saw the timber in some way or other. In general, in slashing or shearing-type chopping machines, the splitting of the block of wood is performed simultaneously with the crosscutting, and the treatment gives the cut surfaces a somewhat uneven, unclean and untidy appearance. For this reason, these machines are not favored especially in commercial production of small-dimensioned wood.

Sawing-type chopping machines, which generally use either a chain saw or a circular saw to crosscut the timber, produce cleaner and more accurately cut material. However, the same saw blade cannot be used for splitting the timber, so these machines are generally either used in conjunction with a separate splitting apparatus or the piece cut off the timber is allowed to fall into a feeder from which it is pushed by a suitable ram through a splitting blade.

The problem with sawing-type chopping machines is that they are slow in operation and difficult and laborious to use. The timbers generally have to be fed manually to the crosscutting device, and in the splitting apparatus placed after it the blocks of wood often have to be guided manually or at least the apparatus requires continuous supervision.

U.S. Pat. No. 3,862,651 describes a chopping machine representing prior-art technology. In this solution, a chain saw is used as a crosscutting device and the feeder used to pass the timber to the crosscutting device is a long trough-like structure with a conveyor belt on its bottom. The conveyor belt is connected to the ram of a splitting apparatus so that, after pushing the block of wood to be split through the splitting blade, the ram engages the conveyor belt during its return movement, thus moving the timber to be crosscut a certain distance forward to the crosscutting device.

The equipment described in the patent is a workable solution as regards its basic idea, but it has certain drawbacks that make it commercially non-viable. First, a large proportion of the timbers to be chopped into small-dimensioned wood have curvatures, curved parts and boughs or branches. Such a timber will not move forward in the feeder according to the patent but only rests on the edges of the trough. Thus, the material has to be fed into this apparatus purely manually. Further drawbacks are the complexity of the equipment and the consequent poor durability. In practical work and in varying working conditions, the timbers are not neatly placed into the trough serving as a feeder; instead, they are more or less thrown or dropped into it. Therefore, the entire structure of the trough must be as simple and durable as possible. The conveyor belt on the bottom of the trough according to the patent does not meet these requirements.

SUMMARY OF THE INVENTION

The object of the invention is to eliminate the problems referred to above. A specific object of the invention is to disclose a new type of chopping machine that has a very simple, durable and reliable construction that allows a maximum degree of automation in the handling of wood in sawing-type chopping machines.

The chopping machine of the invention comprises a crosscutting device for cutting a timber across the grain. The crosscutting device is preferably a chain saw driven either hydraulically or by a motor, but it is also possible to use e.g. a circular saw blade. Moreover, the chopping machine comprises a feeder for feeding the timber longitudinally to the crosscutting device, said feeder comprising two elongated supporting surfaces forming a substantially horizontal trough open in the upward direction, in which the timber to be treated can be placed. In addition, the chopping machine comprises a splitting apparatus operated by a splitting cylinder for splitting a block of wood cut off a timber. According to the invention, one of the elongated supporting surfaces is connected to a suitable power means so that the supporting surface can be moved back and forth in the longitudinal direction of the trough formed by the supporting surfaces, i.e. in lengthways direction of the timber to be crosscut. In addition, according to the invention, both supporting surfaces are provided with directional holding elements on the inner surfaces of the trough, arranged in its longitudinal direction to prevent the timber in the trough from moving in relation to the surface away from the crosscutting device. In other words, the holding elements are so directed in the longitudinal direction of the trough that the timber placed upon them can slide over them in one direction but cannot move in relation to the holding elements in the other direction. Thus, as the supporting surfaces are moving longitudinally back and forth in relation to each other, the holding elements in the supporting surfaces alternately hold the timber immovable in relation to the respective supporting surface while the timber is sliding in relation to the other supporting surface. In this way, the back-and-forth movement of the supporting surfaces causes the timber to move in the hold direction of the holding elements.

In a preferred case, the splitting cylinder of the splitting apparatus is used as a power means for moving the movable supporting surface. This makes it possible for the timber to be already moved forward to the position required for the next crosscutting action while the previous piece cut off is being split.

The holding elements are preferably so disposed that they cover substantially the entire area of both supporting surfaces. Therefore, it is not necessary that the timber being treated should rest on the supporting surfaces throughout its length or the length of the supporting surfaces; instead, e.g. in the case of a curved timber, even a less perfect contact with the supporting surfaces will be enough to ensure a sufficient grip to move the timber forward. The holding element preferably consists of a projection or tongue protruding from the supporting surface and extending toward the crosscutting device, the extremity of said projection or tongue forming a sharp edge suitably directed. Thus, the holding elements may be relatively small, round or angular, scale-like or prong-like elements or longer transverse edges. An essential feature of the holding elements is that their hold or grip on the timber is considerably better in one direction than in the other direction.

The movable supporting surface and the splitting cylinder are preferably connected via a coupling that allows the splitting movement for splitting the block of timber to be made longer than the timber feed motion. This is preferably implemented by using a coupling that comprises a backlash allowing the splitting cylinder to move through a distance while the supporting surface remains immovable. Thanks to this construction, there is always in the splitting apparatus a space longer than the piece to be cut off the timber for the piece to fall into. Therefore, neither end of the piece will remain supported so as to keep the piece in an oblique position, but the piece will always fall into a space long enough to allow it to rest throughout its length on the bottom of the space in a straight position. This guarantees that the splitting apparatus will work properly and that the piece of timber to be split is always in the correct position when pushed into the splitting blade.

In the chopping machine of the invention, it is also possible to use an arrangement that allows an alternating motion of both supporting surfaces. In this case, while one surface is moving forward, the other one is moving backward, resulting in a very fast timber feed action. In particular, when a splitting apparatus with two splitting rams placed side by side is used, the motion of one splitting ram can be coupled to a first supporting surface and the motion of the other splitting ram to a second supporting surface. In this way, the feeding, crosscutting and splitting of the timber can be implemented as a fast and continuous process.

As compared with prior art, the chopping machine of the invention has significant advantages. In the invention, the action of feeding the timber to the crosscutting device is implemented using a very simple and reliable arrangement that comprises no complex parts or parts susceptible to damage. Thus, the handling of the timber is made as easy and simple as possible, in other words, the timber need not be separately fed to the crosscutting device; instead, just placing or even throwing the timber into the feed trough formed by the supporting surfaces is sufficient. Likewise, by virtue of the simple structure and reliability of the crosscutting device, feed device and splitting apparatus and the co-ordination of their operation, the whole apparatus can be relatively easily automated so as to achieve a chopping machine that, like the shearing-type machines used at present, will carry out the entire chopping process automatically after a timber is given to the machine.

BRIEF DESCRIPTION OF THE DRAWINGS

In the following, the invention will be described in detail with reference to the drawings, wherein.

DETAILED DESCRIPTION OF THE INVENTION

Figure 1:
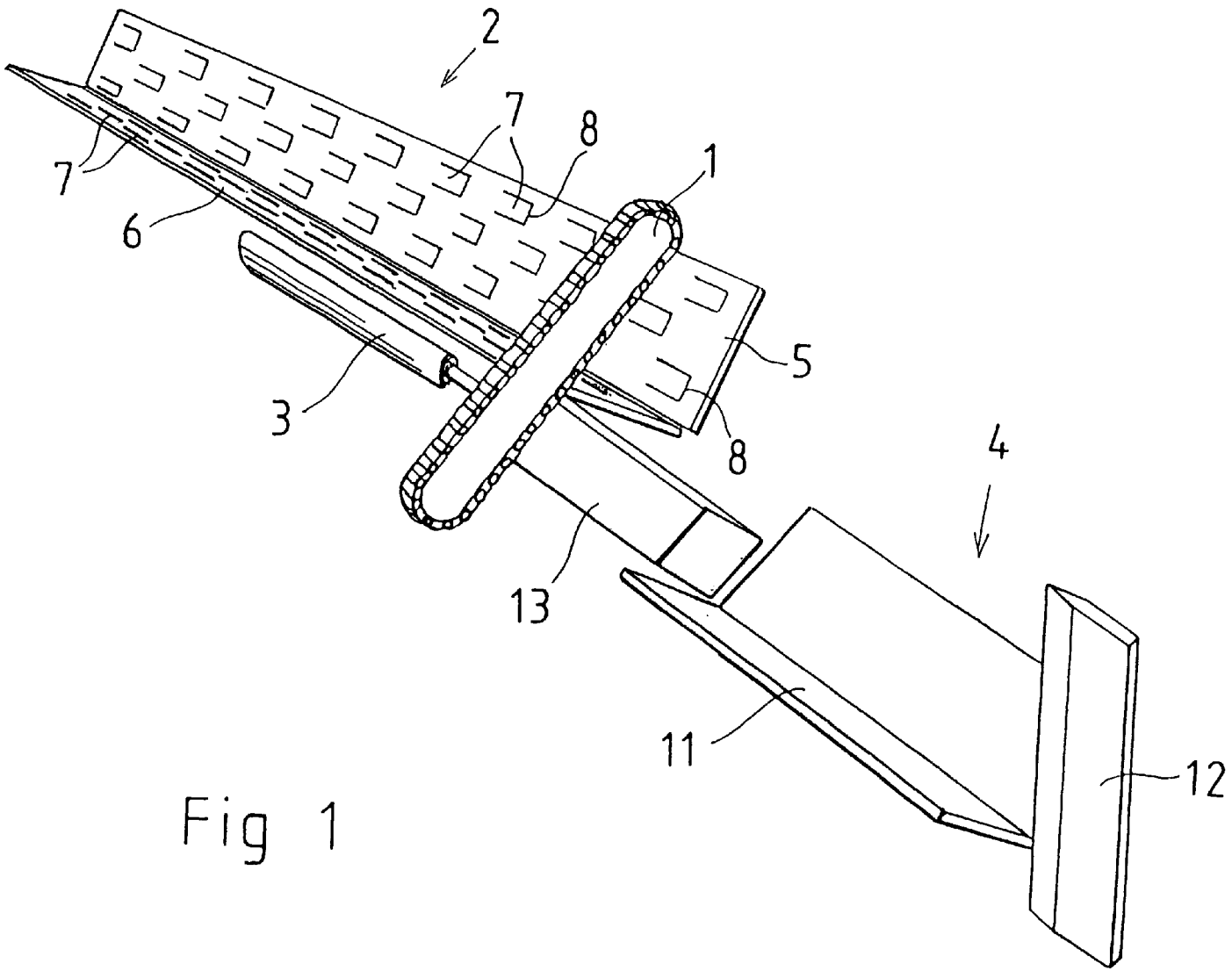
FIG. 1 presents a diagrammatic perspective view of a chopping machine according to the invention.

The chopping machine presented in the drawings comprises a chain saw constituting a crosscutting device 1, which preferably is driven by a hydraulic motor. Placed on one side of the crosscutting device, i.e. before the crosscutting device, is a feeder 2 consisting of two elongated and planar supporting surfaces 5 and 6 mounted at an angle relative to each other so that they form a substantially rectangular trough open in the upward direction. The whole area of each supporting surface 5 and 6 is substantially completely covered or provided with directed holding elements 7, projections. The projections have been punched through the plates 5 and 6 into a rectangular shape and left attached to the plate at one side of the rectangle. Thus, the projections protrude from the plane of the surfaces 5 and 6 upward toward the crosscutting device 1, so that a sharp edge 8 is formed at their extremity pointing toward the crosscutting device 1.

The chopping machine comprises a splitting apparatus 4 placed on the other side of the crosscutting device 1 and comprising an upward open feeder trough 11 into which the cut piece of timber can fall. Mounted at the end of the feeder trough 11 is a splitting blade, which splits the piece of wood when the latter is driven toward the blade. The blade may be an upright blade that only divides the wood into two parts, but it is also possible to use cross-edged blades known in themselves to cut the block into four parts. The structure may also comprise adjustment arrangements known in themselves to allow height adjustment of the cross-edged blade.

Figure 2:
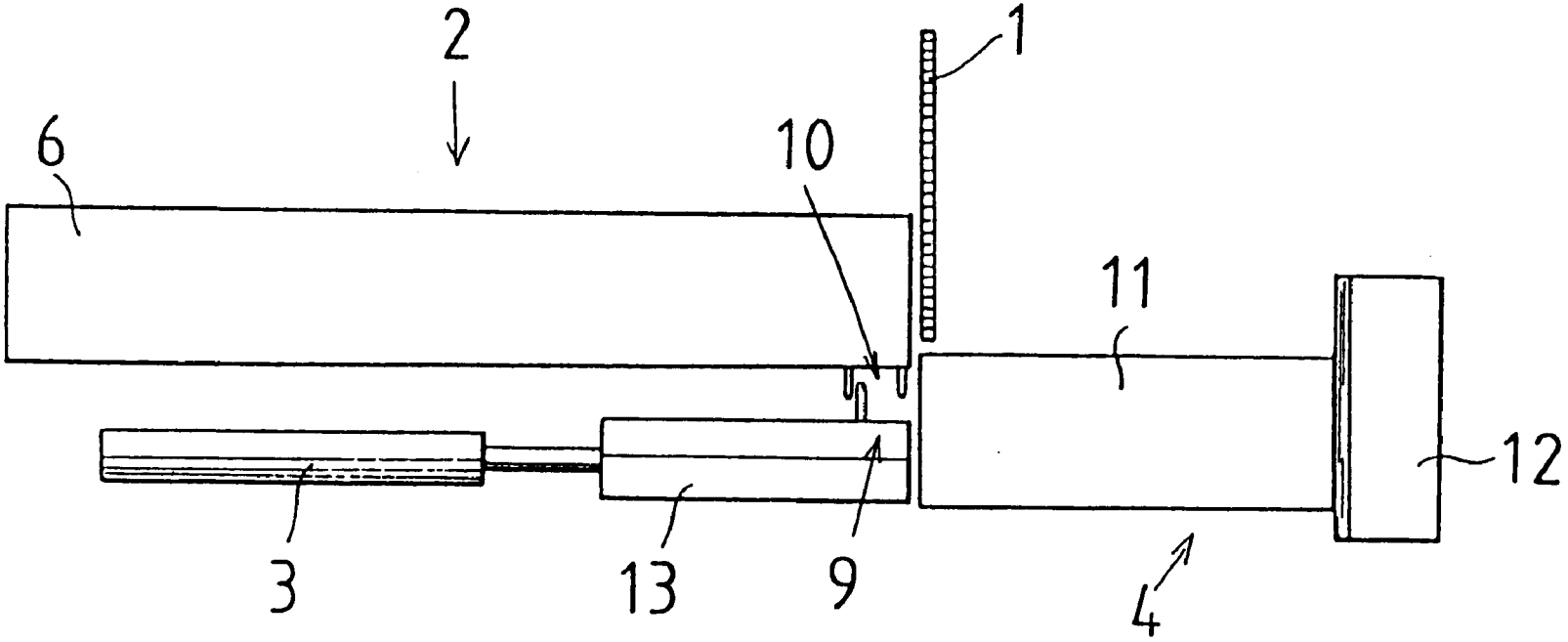
FIG. 2 presents a diagrammatic side view of the chopping machine in FIG. 1.

In addition, the splitting apparatus 4 comprises a splitting ram 13 operated by a splitting cylinder 3 and arranged to push the block of wood in the trough 11 through the blade 12. The splitting ram 13 and one 5 of the supporting surfaces are interconnected via a coupling 9, which is diagrammatically depicted in FIG. 2. Due to this coupling, as the splitting ram 13 is being pushed by the splitting cylinder 3 toward the splitting blade 12, the supporting surface 5 is also moved in the same direction substantially through the same distance. However, this coupling 9 is so implemented that it allows a certain backlash 10, so that, when the splitting movement begins, the supporting surface 5 will not start moving with it immediately but only some 5–10 cm after the splitting movement. Thus, the splitting movement is longer than the timber feed motion for a new crosscut, with the result that a space clearly longer than the length of the block just cut off the timber is formed in the trough 11 for the block, so the block can fall unobstructed into this space.

The apparatus according to the invention presented in the drawing works as follows. When a timber to be treated is placed upon the supporting surfaces 5 and 6 and the apparatus is started, the following actions occur. The splitting cylinder 3 pushes the splitting ram 13 toward the splitting blade 12 even if there is no block to be split. At the same time, supporting surface 5 advances in the same direction while the holding elements 7 in the supporting surface 5 engage the timber, drawing it toward the crosscutting device and further. The holding elements 7 in the other supporting surface 6 slip in this direction, in other words, they let the timber driven by supporting surface 5 slide over them. When the splitting ram 13, drawn by the splitting cylinder 3, returns to its initial position, supporting surface 5 also returns to its position directly opposite to the fixed supporting surface 6. At this point, the crosscutting device 1 performs a crosscutting action, i.e. the crosscutting blade turns while rotating, sawing a piece off the timber. The piece falls into the splitting trough 11 below.

After this, the blade 1 rises to its high position and preferably stops running. Next, the splitting cylinder 3 pushes the splitting ram into the trough 11, where the block of wood to be split is lying. Thus, the block is pushed through the splitting blade 12, which cleaves it in two. Due to the coupling 9, the same movement causes the timber between the supporting surfaces 5 and 6 to move forward through a distance that is again somewhat shorter than the movement determined by the splitting cylinder. During the return motion, supporting surface 5 again returns to its position directly opposite to supporting surface 6. During this movement, the holding elements 7 in supporting surface 6 hold the timber immovable while the holding elements in supporting surface 5 can slide along the surface of the timber. Thus, the timber remains in the position to which it was moved by supporting surface 5 during the previous splitting action.

In this way, the process is carried on, possibly completely automatically, and while the machine is crosscutting and splitting a timber, the operator can already get the next timber ready for treatment, and so the chopping machine can be operated continuously without any breaks by just one person.

The invention has been described above by way of example with reference to the attached drawings while different embodiments of the invention are possible within the scope of the inventive idea defined in the claims.

What is claimed is:

1. A chopping machine for cutting and splitting a timber, said chopping machine comprising:

a crosscutting device for cutting the timber;

a feeder for feeding the timber in its longitudinal direction to the crosscutting device, said feeder comprising a first elongated supporting surface and a second elongated supporting surface, the two elongated supporting surfaces forming a substantially horizontal trough open in the upward direction, into which the timber to be treated can be placed;

a splitting apparatus operated by a splitting cylinder for splitting a block cut off the timber, a power means connected to the first supporting surface for moving the first supporting surface back and forth in the longitudinal direction of the trough; and directional holding elements provided on the supporting surfaces and arranged in the longitudinal direction of the trough to prevent the timber from moving in relation to the surfaces away from the crosscutting device.

2. The chopping machine as defined in claim 1, wherein the power means comprises a splitting cylinder of the splitting apparatus.

3. The chopping machine as defined in claim 1, wherein the holding elements comprise projections protruding from the supporting surfaces and extending toward the crosscutting device, the extremity of each of said projections forming a sharp edge.

4. The chopping machine as defined in claim 1, wherein the holding elements cover substantially the entire area of the supporting surfaces.

5. The chopping machine as defined in claim 1, further comprising a coupling between the first supporting surface and the splitting cylinder, said coupling implementing a timber block splitting movement that is longer than the timber feed motion.

6. The chopping machine as defined in claim 5, wherein the coupling comprises a backlash allowing the splitting cylinder to move through a distance while the first supporting surface remains immovable.

* * * * *